United States Patent [19]

Ohniwa

[11] Patent Number: 4,478,160

[45] Date of Patent: Oct. 23, 1984

[54] PATTERN SEWING MACHINE

[75] Inventor: Kohichi Ohniwa, Aichi, Japan

[73] Assignee: Mitsubishi Denki Kabushiki Kaisha, Tokyo, Japan

[21] Appl. No.: 434,284

[22] Filed: Oct. 14, 1982

[30] Foreign Application Priority Data

Oct. 14, 1981 [JP] Japan ..... 56-163887

[51] Int. Cl.[3] ..... D05B 21/00

[52] U.S. Cl. ..... 112/121.12; 112/275

[58] Field of Search ..... 112/158 E, 121.12, 275, 112/121.11, 102, 103, 277

[56] References Cited

U.S. PATENT DOCUMENTS

| | | | |
|---|---|---|---|
| 3,987,739 | 10/1976 | Wurst et al. | 112/275 X |
| 4,120,254 | 10/1978 | Herr et al. | 112/158 E |
| 4,135,459 | 1/1979 | Manabe et al. | 112/121.12 |
| 4,309,950 | 1/1982 | Franklin | 112/275 |
| 4,325,313 | 4/1982 | Kawai et al. | 112/121.12 X |
| 4,351,254 | 9/1982 | Brown | 112/275 X |

*Primary Examiner*—Peter Nerbun

*Attorney, Agent, or Firm*—Sughrue, Mion, Zinn, Macpeak and Seas

[57] ABSTRACT

A pattern sewing machine comprises a cloth feeding mechanism for moving a piece of cloth; a sewing machine mechanism driven independently of the cloth feeding mechanism; a memory element in which control data including pattern data and sewing machine drive data are stored; a control circuit for synchronously driving the cloth feeding mechanism and the sewing machine mechanism according to the control data stored in the memory element; a temporary stop instruction for stopping the sewing machine mechanism during sewing; and a minute movement instruction for driving the cloth feeding mechanism only, the control circuit having a function of driving the cloth feeding mechanism according to the minute movement instruction after the cloth feeding mechanism has been stopped by the temporary stop instruction, and a function of driving the cloth feeding mechanism according to the pattern data thereafter.

12 Claims, 5 Drawing Figures

PATTERN SEWING MACHINE

BACKGROUND OF THE INVENTION

1. Field of the Invention

This invention relates to an electronic pattern sewing machine with a cloth feeding device including pulse motors, and more particularly to a temporary stop device for stopping the sewing machine during sewing.

2. Description of the Prior Art

The operation of a conventional electronic pattern sewing machine is controlled according to a sewing machine controlling program. Accordingly, the sewing machine suffers from the problem that the sewing machine is driven until the end of the pattern is reached and, even though the operater may want to stop the sewing machine immediately when the thread is cut, it is impossible to stop the sewing machine. Accordingly, no stitches are formed after the point where the thread has been cut, but holes are formed in the sewn article with the needle so that the sewn article becomes unsatisfactory as a product. Even if an attempt is made to trace the holes thus formed with the thread, it is considerably difficult to accurately position the sewn article back to the point where the thread has been cut. Thus, in practice, it is difficult to sew an article again.

SUMMARY OF THE INVENTION

In view of the foregoing, an object of this invention is to provide a pattern sewing machine with is designed so that the sewing machine can be stopped during sewing and a cloth feeding device can be driven as desired, and so that, when the thread is cut during sewing, the sewing machine is stopped to reconnect the thread, so that sewing the pattern can be started according to the predetermined control program.

The foregoing object and other objects of the invention have been achieved by the provision of a pattern sewing machine according to the invention, which comprises: a cloth feeding mechanism driven by a first motor; a sewing machine mechanism driven by a second motor; a memory element in which control data are stored, the control data including pattern data for determining the direction and amount of rotation of the first motor; a control circuit for reading the control data, to synchronously drive the cloth feeding mechanism and the sewing machine mechanism; temporary stop instruction means for stopping the sewing machine mechanism during sewing; and minute movement instruction means for moving the cloth feeding mechanism only, the control circuit comprising: a first control element responsive to an instruction from the temporary stop instruction means for stopping a needle at a predetermined position and for stopping the cloth feeding mechanism; and a second control element for minutely moving, according to the data, the cloth feeding mechanism from a position where the cloth feeding mechanism has been stopped, and thereafter driving the sewing machine mechanism and cloth feeding mechanism according to the control data.

BRIEF DESCRIPTION OF THE DRAWINGS

The nature, principle and utility of the invention will become more clear from the following detailed description and the appended claims when read in conjunction with the accompanying drawings, in which:

DETAILED DESCRIPTION OF THE PREFERRED EMBODIMENT

One preferred embodiment of this invention will now be described with reference to the accompanying drawings.

Figure 1:
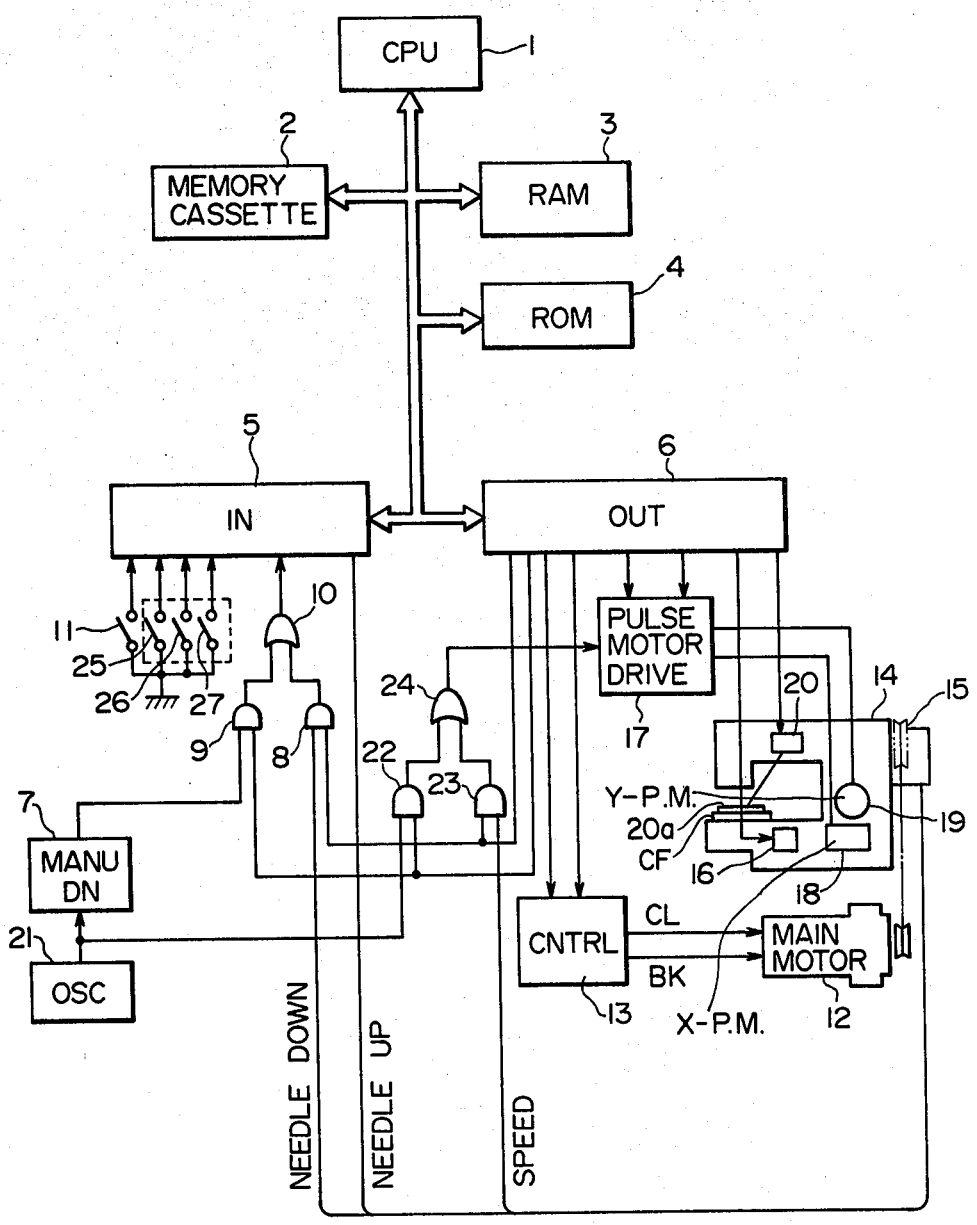
FIG. 1 is a block diagram showing one preferred embodiment of this invention.

FIG. 1 shows a control device for a pattern sewing machine according to the invention. In FIG. 1, reference numeral 1 designates a CPU (central processing unit); 2, a memory element for storing pattern data and a cassette for protecting the memory element (hereinafter referred to as "a memory cassette 2", when applicable); 3, a RAM (random access memory); 4, a ROM (read-only memory) in which a control program for the entire sewing machine is stored; 5, an input port for reading and transferring all input data to the CPU; and 6, an output port for outputting output data from the CPU. The above-described circuit elements (1) through (6) form a microcomputer section.

Further in FIG. 1, reference numeral 21 designates a pulse oscillator for providing an output pulse. A cloth feeding device CF coupled to motors 18 and 19 by a linkage mechanism (not shown) is driven in synchronization with the oscillator pulse when the sewing machine is not rotated. Reference numeral 7 designates a circuit for frequency-dividing the output pulse of the pulse oscillator. As will be described in more detail below, the circuit 7 is used to provide a pulse which is used as a needle lower position signal when the machine is not in operation. (Circuit 7 will hereinafter be referred to as "a manual lower position circuit", when applicable). Reference numerals 8, 9, 22 and 23 designate AND circuits; 10 and 24, OR circuits; 11, a pattern sewing start switch; 12, a variable speed type main motor for driving the machine mechanism, the main motor 12 comprising a flywheel section (not shown) which rotates at all times, and a clutch brake section (not shown) for transmitting the rotation of the flywheel section to the sewing machine; 13, a main motor control circuit for controlling the clutch brake, either to rotate the main motor at a constant speed or for stopping the main motor at a predetermined position; 14, the sewing machine; 15, a detector for detecting the sewing machine's needle position and for detecting the number of revolutions per minute of the sewing machine; 16, a thread cutting device; 18, an X-direction driving pulse motor for the cloth feeding device; 19, a Y-direction driving pulse motor, the pulse motors 18 and 19 driving the cloth feeding device through a well-known belt or rack-and-pinion device by which the rotational movement of the pulse motors is converted to linear movement, to move the cloth as desired, to thereby sew a desired patter; and 20, a cloth retaining device for operating a clamping portion 20*a* of the feeding device for holding a piece of cloth in the cloth feeding device.

Further in FIG. 1, reference numeral 17 designates a pulse motor drive circuit in which pulse motor driving data are received in parallel from the output port 6 and are converted into a sewing machine rotation signal and series data synchronous with the signal from the pulse oscillator 21, to drive the pulse motors 18 and 19; 25, a temporary stop switch; 26, a positive-direction minute movement switch; and 27, a negative-direction minute movement switch.

Figure 2:
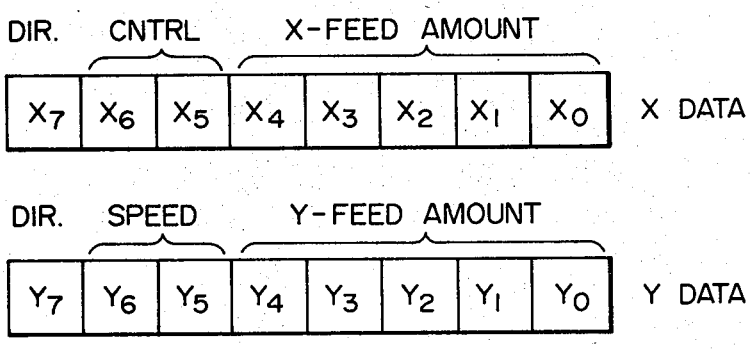
FIG. 2 is an explanatory diagram showing the arrangement of pattern data stored in a memory element in FIG. 1.

Two kinds of pattern data are stored in the memory cassette 2, i.e. X-direction drive data and Y-direction drive data as shown in FIG. 2, each of which is made up of eight (8) bits. The bits $X_0$ through $X_4$, and $Y_0$ through $Y_4$ provide data concerning the amount of feed (or rotation). The bits $X_5$, $X_6$, $Y_5$ and $Y_6$ provide sewing machine control data, and bits $X_7$ and $Y_7$ provide feed direction (or rotation direction) data. The sewing machine control data ($X_5$, $X_6$, $Y_5$, $Y_6$) include four data indicating sewing starting (motor starting), thread cutting, idle feeding and sewing ending.

Figure 3A:
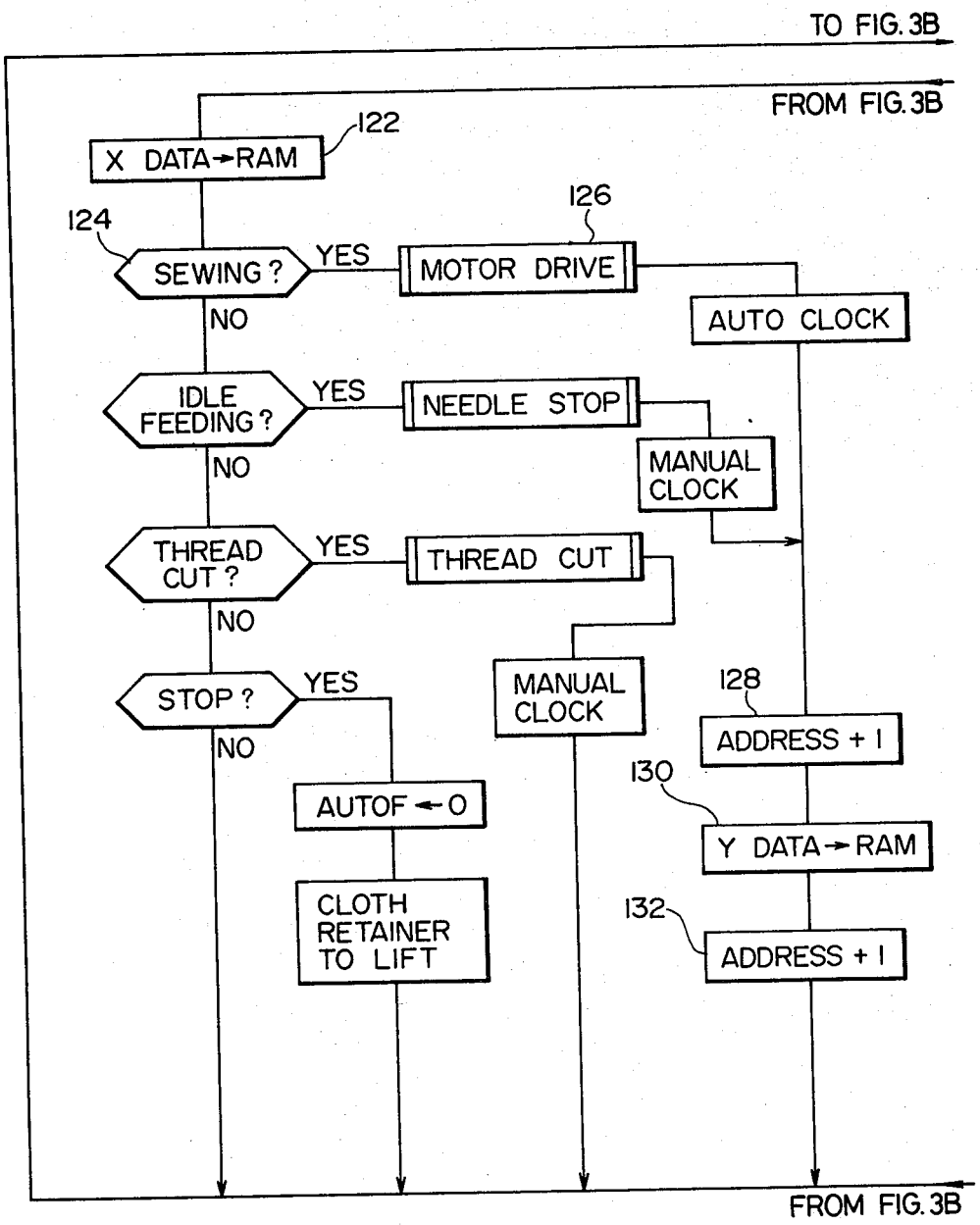
FIGS. 3A–3C show a flow chart for a description of an embodiment of the invention.
Figure 3B:
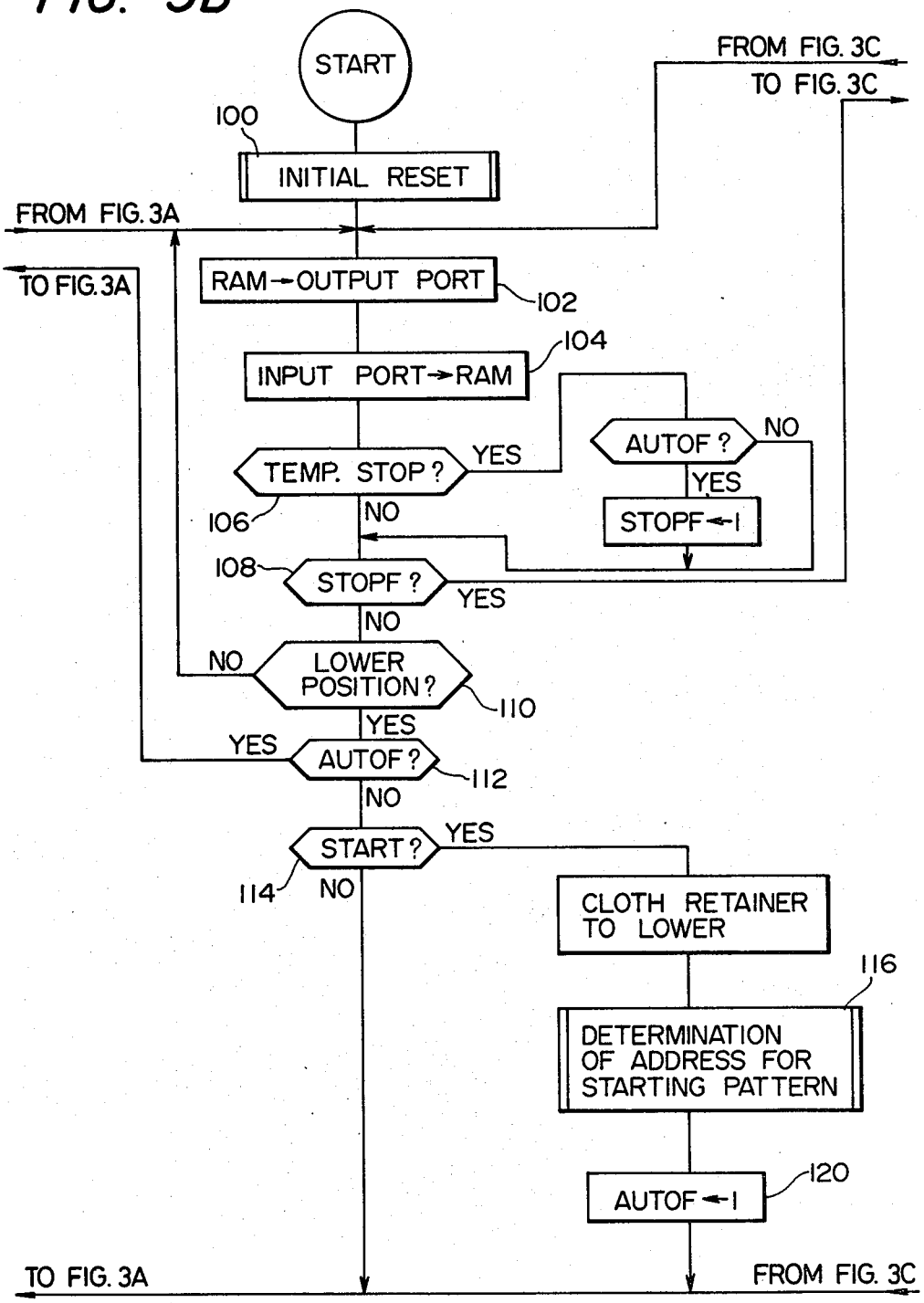
Figure 3C:
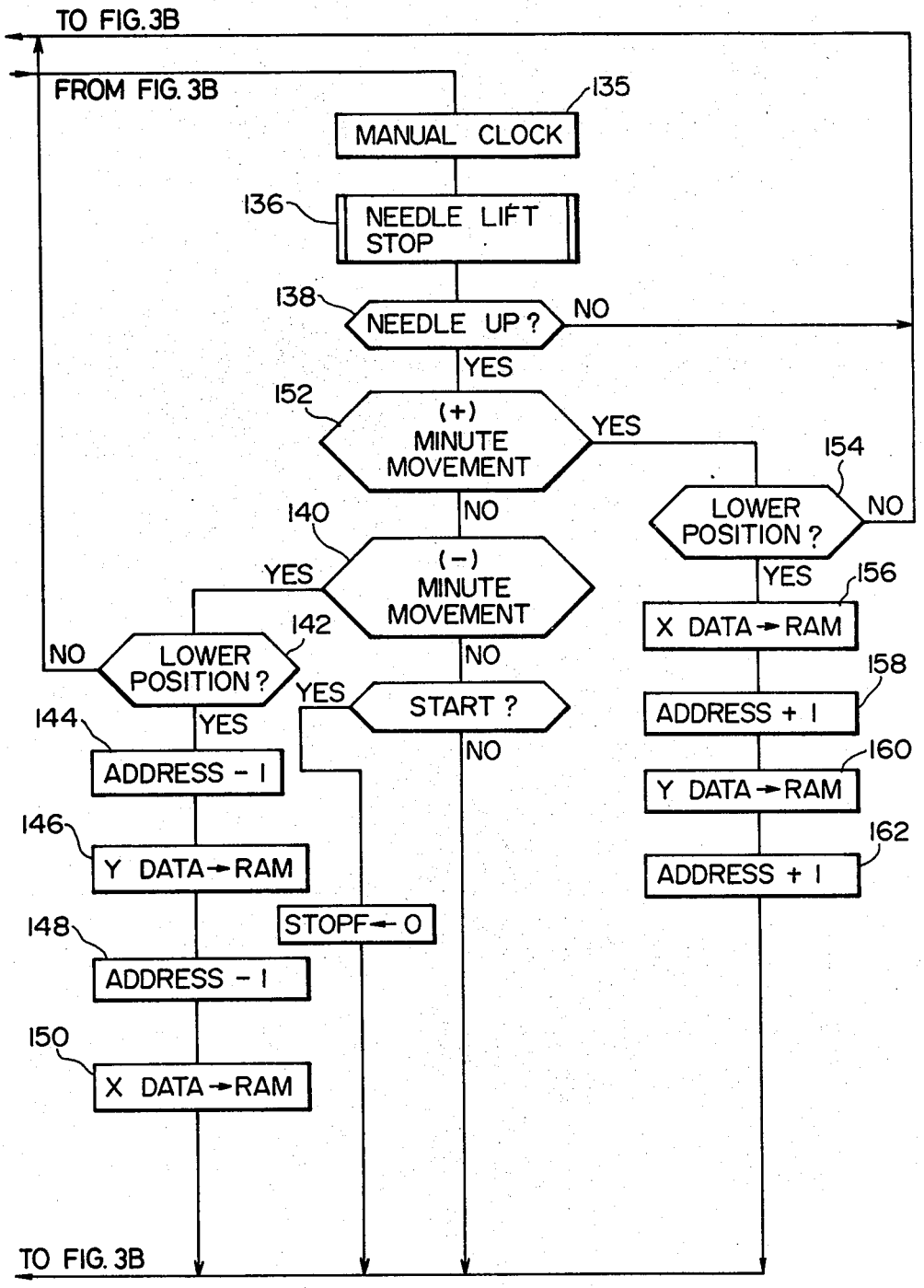

The operation of the pattern sewing machine according to the invention will be described with reference to FIG. 3 which shows a flow chart showing the sequence of operation of the pattern sewing machine.

Upon operation of the power switch, the CPU 1 begins performing control according to data from the ROM 4 in which the controlling program has been stored. First, the CPU 1 carries out the initial reset operation in subroutine 100, to thereby place all the parts of the microcomputer section in an initial state. Then, initial state data are outputted from the output port 6 in step 102, so that the other control sections are placed in an initial reset state. Next, input data (e.g. a start signal and a needle position signal) are read through the input port 5 in step 104. Since the temporary stop switch 25 has not been activated, and with the Stop Flag STOPF in a reset state, the program is followed through steps 106 and 108 to step 110 in FIG. 3, and a signal from the output port 6 is applied to the AND circuit 9 so that the output signal of the manual lower position circuit 7 is applied to the input port 5 through OR gate 10. The detection of the moment when the lower position signal is generated (both for "manual" and "auto") is indicated at step 110 in FIG. 3. For the automatic operation, the detector 15 is so adjusted that, when the sewing machine is rotated, the lower position signal is produced at the instant when the needle is removed from the cloth. Accordingly, the detector 15 is used to enable the operation of the cloth feeding device after removal of the needle from the cloth.

When the lower position signal is detected at step 110, and since the Auto Flag AUTOF has not yet been set, the flow chart is followed through step 112 to step 114. The previous depression of the start switch will have resulted in the application of a start signal through the input port 5. This start signal will be detected at step 114, and the cloth retainer of the cloth retaining device 20 will then hold the cloth at the time instant when the lower position signal is produced. Under this condition, in subroutine 116, a pattern data top address, or starting address, is determined from the memory cassette 2 in which the data of a pattern to be sewn have been stored. Then, an Auto Flag AUTOF is set in step 120. After the AUTOF has been set, control is returned to the top of the flow chart. Thus, the determination of the pattern data top address is performed only once after the depression of the start switch. Thereafter, upon the occurrence of the next manual lower position signal detected at step 110, the set condition of the AUTOF will be detected at step 112 so that the data in the top address will be read at step 122. The data in this case is the eight bits of X data in FIG. 2, with the Y data being stored in the next address in the memory cassette 2. The X and Y data are alternately stored in consecutive addresses. The starting of the sewing operation or the starting of the idle feeding operation for driving only the cloth feeding device are determined from the data in the bits $X_5$ and $X_6$ of the X data. For instance, when the first eight bits of X data are transferred to the RAM at step 122, the bits $X_5$ and $X_6$ are examined. If the starting of the sewing operation is indicated by bits $X_5$ and $X_6$, this will be detected at step 124, and the motor starting process is carried out in subroutine 126. The clock signal is then switched over to automatic, whereby a signal from output port 6 will enable AND gate 8 so that the rotation signal from the detector 15 of the sewing machine 14 will be provided through gate 8 and OR gate 10 as an automatic clock signal to the input port 5. The data address is then advanced by one address increment at step 128 so that the Y data occupying the next address location in the memory cassette 2 will be transferred to the RAM at step 130. The address is then further incremented by one address at step 132, and the program returns to the top of the flow chart of FIG. 3.

Thereafter, the X data and Y data stored in the RAM 3 are outputted through the output port 6 in step 102 and transferred to the pulse motor drive circuit 17. At the same time, the rotation of the sewing machine results in the application of a sewing machine rotation pulse to the circuit 17 through the AND circuit 23 and the OR circuit 24. As a result, the circuit 17 generates a pulse motor drive pulse in synchronization with the rotation of the sewing machine, whereby the pulse motors 18 and 19 are rotated according to the pattern data.

The sewing operation is started as described above. When ending data and thread cutting data are included, after the thread has been cut, the needle is stopped, and the cloth retainer of the cloth retaining device 20 is lifted to release the cloth. When the sewing machine 14 is stopped, no sewing machine rotation pulse is provided by the detector 15. Therefore, the "auto" clock is switched over to the "manual" clock by disabling gate 8 and enabling gate 9 so that the control circuit is operated in accordance with the output pulse of the oscillator 21.

It is assumed that the thread is cut during sewing. In this case, when the temporary stop switch 25 is operated, the temporary stop data is read through the input port 5 and a STOPF is set. The STOPF can be set only when the AUTOF haes been set. That is, if a sewing operation has been ended and the sewing machine 14 is not in operation, it is unnecessary to receive the temporary stop data even if the temporary stop switch is operated, since the temporary stop is unimportant. Thus, with the AUTOF reset, and the temporary stop is ignored.

Assuming there is no step data and that the AUTOF remains set, the set condition of the STOPF is detected at step 108 and a procedure for stopping the sewing machine with the needle set at the upper position is carried out by switching from the "auto" clock to the "manual" clock at step 135 and then iteratively performing subroutine 136 and decision step 138. The position of the cloth feeding device when the sewing machine is stopped with the needle set at the upper position by operating the temporary stop switch 25 is often beyond the position where the thread has been cut, and the pattern data will also have advanced. In this case, the negative-direction minute movement switch 27 is depressed. The depressed condition of the negative-direction minute movement switch 27 will be detected at step 140, and when the next manual lower position signal is provided through AND gate 9 and detected at step 142, the address data will be succesively decremented while reading out the Y and X data in steps 144–150, and the cloth feeding device will be moved backwardly in accordance with the pattern data when each manual lower position signal is produced.

The address of the pattern data has been advanced by one address in the sewing operation. Accordingly, when the sewing machine is stopped temporarily, the address is for the next data, namely, the X data. Therefore, by turning back the address by one address, the Y data used before the sewing machine is stopped is read and stored in the RAM 3. In this operation, the feed direction data in the Y data is reversed. Next, by further turning back the address by one address, the X data, with its direction of feed reversed, is stored in the RAM 3. Next, by outputting the contents of the RAM 3, data opposite to the pattern data outputted immediately before the temporary stop is outputted, whereby the cloth feeding device moves back to the step position according to the pattern data. This operation is continued in synchronization with the output pulse of the pulse oscillator 21 while the negative-direction minute movement switch 27 is kept depressed, and the cloth feeding device is stopped when the switch 27 is released. Similarly, by operating the positive-direction minute movement switch 26, the cloth feeding device is moved in accordance with steps 152–162 to advance the pattern according to the pattern data. When the cloth feeding device has been moved from the thread-cutting location to a desired point, the start switch 11 is depressed and the STOPF is reset in step 166 after detection of the start signal at step 164. Accordingly, the control is returned to the ordinary sewing routine instead of the minute movement routine. Thereafter, the same control as that in the ordinary sewing operation is carried out, and no further description thereof is believed to be necessary.

In the above-described embodiment, the temporary stop switch 25 is manually operated. However, if the switch is replaced by a switch which automatically detects when the thread is cut, then the sewing machine can be stopped automatically immediately when the thread is cut.

As is apparent from the above description, according to the invention, when the thread is cut during sewing, the sewing machine can be stopped temporarily, the cloth feeding device can be moved minutely, and the sewing can then be resumed. Accordingly, in the case where the sewing pattern is intricate and involves a large number of stitches, the amount of labor with the pattern sewing machine according to the invention is much less than that with the conventional pattern sewing machine wherein the sewing would have to be begun all over again. If a sewn article is of thick leather or the like and it is sewn with the thread cut, then holes are formed in the article with the needle, and in this case it is impossible to sew the article again. However, according to the invention, the frequency of occurrence of such unsatisfactory sewn articles can be reduced.

What is claimed is:

1. A pattern sewing machine, comprising:

a cloth feeding mechanism driven by at least one first motor;

a sewing machine mechanism having a needle and driven by a second motor;

memory means for storing control data, said control data including pattern data for determining a direction and amount of rotation of said first motor;

temporary stop instruction means for providing a first instruction for stopping said sewing machine mechanism during sewing;

minute movement instruction means for providing a second instruction for moving said cloth feeding mechanism while said sewing machine mechanism is stopped; and a control circuit for reading said conrol data and for synchronously driving said cloth feeding mechanism and said sewing machine mechanism in accordance with said control data, said control circuit comprising: a first control element responsive to said first instruction for stopping said sewing machine mechanism with said needle at a predetermined position, and for stopping said cloth feeding mechanism; and a second control element responsive to said second instruction for minutely moving said cloth feeding mechanism in accordance with said pattern data from a position where said cloth feeding mechanism has been stopped to a desired position, and for thereafter driving said sewing machine mechanism and cloth feeding mechanism in accordance with said control data.

2. A pattern sewing machine as claimed in claim 1, wherein said minute movement instruction means provides a second instruction for moving said cloth feeding mechanism in first and second opposite directions, and wherein said second control element is responsive to said second instruction for minutely moving said cloth feeding mechanism either in said first direction in accordance with said pattern data or in said second direction in accordance with the reverse of said pattern data.

3. A pattern sewing machine as claimed in claim 1, further comprising a microcomputer for reading said pattern data out of said memory element and delivering said pattern data to said control circuit.

4. A pattern sewing machine as claimed in claim 1, in which said cloth feeding mechanism includes said first motor for feeding said cloth in a first direction and a third motor for feeding said cloth in a second direction perpendicular to said first direction.

5. A pattern sewing machine as claimed in claim 2, further comprising a microcomputer for reading said pattern data out of said memory element and delivering said pattern data to said control circuit.

6. A pattern sewing machine as claimed in claim 2, wherein said at least one first motor is a pulse motor.

7. A pattern sewing machine as claimed in claim 2, wherein said cloth feeding mechanism comprises said first motor for feeding said cloth in a first direction and a third motor for feeding said cloth in a second direction perpendicular to said first direction.

8. A pattern sewing machine as claimed in claim 7, wherein said first motor and said third motor are pulse motors.

9. A pattern sewing machine as claimed in claim 7, further comprising means for generating a rotation signal representing rotation of said sewing machine mechanism, and wherein said control circuit comprises a motor drive circuit for providing a cloth feeding mechanism motor drive signal in synchronization with said rotation signal, said first and third motors responding to said cloth feeding mechanism motor drive signal to feed said cloth.

10. A pattern sewing machine as claimed in claim 7, further comprising first means for generating a rotation signal representing rotation of said sewing machine mechanism, second means including an oscillator for generating a manual signal in the absence of said rotation signal, and wherein said control circuit includes a motor drive circuit responsive to either one of said rotation signal and said manual signal for providing a cloth feeding mechanism motor drive signal in synchronization with said either one of said rotation signal and manual signal, said first and third motors being responsive to said cloth feeding mechanism motor drive signal for feeding said cloth.

11. A pattern sewing machine as claimed in claim 1, wherein said control circuit drives said sewing machine mechanism while synchronously driving said cloth feeding mechanism in accordance with said control data along a sewing path from a first relative position of said needle and cloth to a second relative position of said needle and cloth, wherein said first control element is responsive to said first instruction at said second relative position for stopping said sewing machine mechanism with said needle at a predetermined vertical position, and wherein said second control element is responsive to said second instruction for minutely moving said cloth feeding mechanism in accordance with said pattern data along the reverse direction of said sewing path from said second relative position back to said first relative position, and for thereafter driving said sewing machine mechanism while synchronously driving said cloth feeding mechanism along said sewing path in accordance with said control data.

12. A pattern sewing machine as claimed in claim 1, wherein said control circuit synchronously drives said cloth feeding mechanism and said sewing machine mechanism during a normal sewing operation for sewing along a sewing path between at least first and second positions, and wherein said control element is responsive to said second instruction for moving said cloth feeding mechanism along said sewing path between said first and second positions while said sewing machine mechanism remains stopped.

* * * * *